United States Patent [19]

Fawcett et al.

[11] 4,376,682

[45] * Mar. 15, 1983

[54] METHOD FOR PRODUCING SMOOTH COHERENT METAL CHALCONIDE FILMS

[75] Inventors: William R. Fawcett; Andrzej S. Baranski, both of Guelph, Canada

[73] Assignee: TDC Technology Development Corporation, Vancouver, Canada

[ * ] Notice: The portion of the term of this patent subsequent to Mar. 11, 1997, has been disclaimed.

[21] Appl. No.: 212,863

[22] Filed: Dec. 4, 1980

Related U.S. Application Data

[63] Continuation of Ser. No. 137,721, Apr. 7, 1980.

[51] Int. Cl.[3] ..... C25D 3/02; C25D 9/08

[52] U.S. Cl. ..... 204/14 N; 204/56 R

[58] Field of Search ..... 204/14 N, 56 R

[56] References Cited

U.S. PATENT DOCUMENTS

| | | | |
|---|---|---|---|
| 3,131,134 | 4/1964 | Micillo | 204/14 N |
| 3,616,280 | 10/1971 | Arnold | 204/14 N |
| 3,668,086 | 6/1972 | Hughes | 204/14 N |
| 3,953,234 | 4/1976 | Hoffmann | 204/14 N |
| 4,064,326 | 12/1977 | Mavassen | 204/56 R |
| 4,086,101 | 4/1978 | Jordan | 204/56 R |
| 4,121,981 | 10/1978 | Ward | 204/56 R |
| 4,137,096 | 1/1979 | Maier | 204/56 R |
| 4,192,721 | 3/1980 | Fawcett | 204/56 R |

FOREIGN PATENT DOCUMENTS

| | | | |
|---|---|---|---|
| 1115548 | 5/1968 | United Kingdom | 204/14 N |
| 1272536 | 5/1972 | United Kingdom | 204/14 N |
| 1283024 | 7/1972 | United Kingdom | 204/14 N |
| 1321859 | 7/1973 | United Kingdom | 204/49 |
| 1413494 | 11/1975 | United Kingdom | 204/140 |
| 1449792 | 9/1976 | United Kingdom | 204/46 R |
| 2006268 | 5/1979 | United Kingdom | 204/56 R |
| 2016049 | 9/1979 | United Kingdom | 204/14 N |
| 2022140 | 12/1979 | United Kingdom | 204/56 R |

*Primary Examiner*—T. M. Fufariello

*Attorney, Agent, or Firm*—Ridout & Maybee

[57] ABSTRACT

Smooth coherent metal chalconide film is electroplated onto a cathode from an electroplating bath comprising a solution in an organic polar solvent metal salt and elemental chalcogen at elevated temperature and low current density.

35 Claims, 1 Drawing Figure

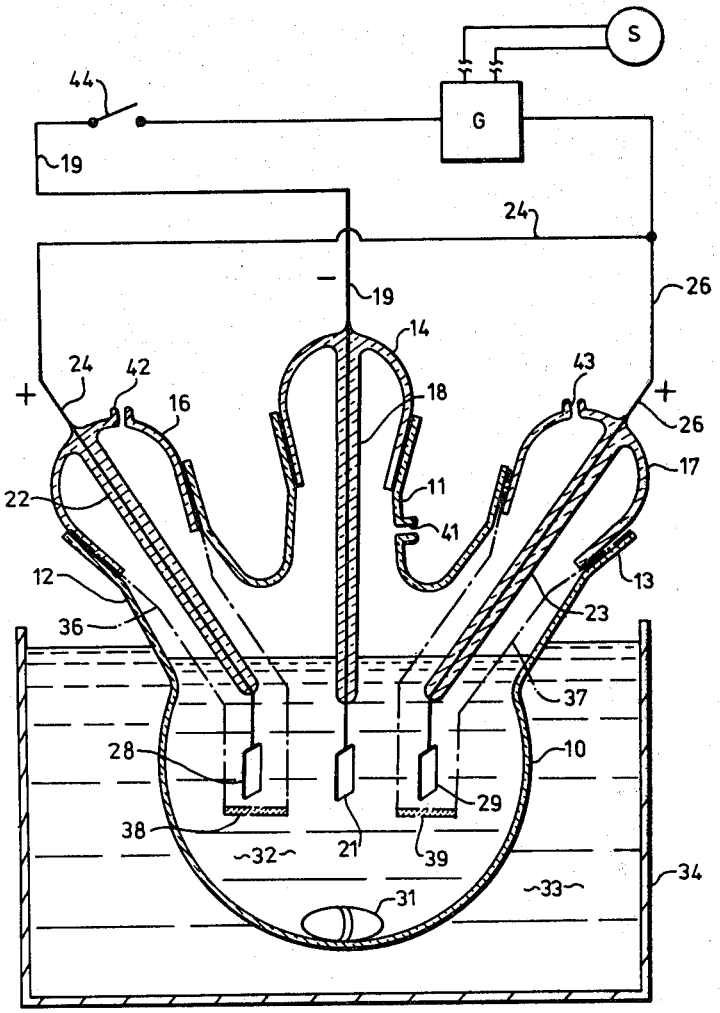
S
G
44
19
24
26
19
14
24
42
16
18
43
26
17
22
11
41
12
13
36
23
37
28
10
29
38
32
21
39
34
33
31

METHOD FOR PRODUCING SMOOTH COHERENT METAL CHALCONIDE FILMS

This application is a continuation of application Ser. No. 137,721 filed Apr. 7, 1980.

The present invention relates to a method for producing a smooth coherent metal chalconide film.

Metal chalconide films display a wide variety of properties that are useful in the electrical and chemical fields. Thus, for example, cadmium sulfide, mercury sulfide, bismuth sulfide and lead sulfide are n-type semiconductors of which thin films have application in solar energy collection devices; thallium sulfide and cuprous sulfide are p-type semiconductors of which thin films have similar uses. Nickel sulfide and cobalt sulfide are metallic conductors, and thin films of these materials have application as catalysts for redox processes involving sulfur compounds. Moreover, these compounds have application in the electronics industry and in the development of ion-selective electrodes for chemical analysis.

Up to the present time, thin films of these sulfide materials have been depositable by vapor deposition methods, but these methods are disadvantageous as they require the utilization of complex and expensive apparatus, or costly reagents are required, and the energy costs of maintaining the necessary reduced-pressure environments and of converting these reagents from the solid to the vapor phase are relatively high.

The object of the present invention is to provide a process whereby at least some of the above-noted disadvantages of prior methods may be mitigated, or which will at least provide a useful alternative to the prior methods.

It has now been found that metal chalconides can be deposited at a cathode as a smooth, coherent film by conducting an electroplating process at low current densities employing as electrolyte a metal salt dissolved in an organic polar solvent, in which is also dissolved chalcogen in elemental form, with the electrolytic bath being maintained at elevated temperature.

In accordance with the invention, there is provided a method for producing a smooth coherent metal chalconide film of which the metal moiety is at least one of Cd, Pb, Hg, Cu, Bi, Co, Ni, Tl, Ag, In, and Fe and the chalconide moiety is at least one of S, Se, and Te comprising electroplating said film onto a cathode from an electrolytic bath comprising an organic polar solvent having dissolved therein (a) at least one salt of said metals that is ionised and is electrically conductive in solution in said solvent and (b) at least one of said chalcogens in elemental form, the bath being maintained at elevated temperature, and the electrolysis being carried out at a current density that is sufficiently low at the cathode that a smooth coherent film of said chalconide is deposited on the chathode.

In general, the metal chalconides of which thin films are prepared by the techniques of the present invention, may be represented by the general formula $$M_m X_x$$

wherein M is one or more of Cd, Pb, Hg, Cu, Bi, Co, Ni, Tl, Ag, In or Fe; X is S, Se, Te or two or more of these, and m and x are integers satisfying the valencies of the chalcogen and the metal, respectively.

Where the electrolytic bath contains a salt of only one of the metals Cd, Pb, Hg, Cu, Bi, Co, Ni, Tl, Ag, In, or Fe, and only one of the chalcogens S, Se, and Te a coherent film of a single metal chalconide is obtained on the cathode. Using a bath containing two or more of said metals or two or more of said chalcogens, a mixed chalconide film may be obtained. For example, if the metal salts dissolved in the bath comprise a major amount of one of said metals and a minor amount of another of said metals, a metal chalconide film containing another metal as a minority dopant may be obtained.

In conducting the present film-producing method, there is employed an electrolytic bath comprising an organic polar solvent having dissolved therein one or more ionised, electrically conductive salts of the metal M, and having also dissolved therein the or each chalcogen X in elemental form. The bath is maintained at an elevated temperature (above ambient temperature) as this is conducive to the formation of smooth coherent films of the metal chalconide at increased rates of deposition, as discussed in more detail below. Electrolysis is conducted at a low current density such that a smooth, coherent film of the chalconide is electroplated out on the cathode. The electrolysis is conducted until such time as the required thickness of deposit of film, which deposits out on the cathode, is built up.

Although the mechanism of the electroplating process is not at present fully understood, it is suggested that this consists in electrolytic reduction of the cation of the metal M to an active form at the surface of the cathode. The active metal atom reacts rapidly with the chalcogen X dissolved in the organic polar solvent to form the metal chalconide. Thus, in the case of, for example, a metal that is divalent, the equations for the reaction at the cathode are as follows:

$$M^{++} + 2e \rightarrow M^* \quad (1)$$

$$M^* + X \rightarrow MX \quad (2)$$

where M* represents the active metal atom.

The nature of the reaction at the anode is not presently well understood, but appears to involve oxidation of the organic polar solvent.

It has been found that when the current density at the cathode surface is maintained sufficiently low, so that the rate of formation of active metal atoms M* at the cathode in accordance with equation (1) is relatively slow, then the rate of the chalconide-forming reaction in accordance with equation (2) can proceed sufficiently rapidly that there is substantially no formation of free metal, and a smooth, coherent deposit of the metal sulfide or other chalconide is obtained. However, at excessively high current densities, the rate of formation of active species M* is so high that appreciable quantities of free metal are deposited at the cathode, so that a matt, powdery, or non-glassy deposit is obtained, owing to inclusions of free metal in the deposit. Moreover, at excessively high current densities, there is the tendency for dendritic growth of the chalconide deposit, leading to the formation of non-coherent films.

As noted above, the metal chalconides that have useful electrical and chemical properties, and to which the present electroplating method is applicable comprise the chalconides, and especially the sulfides, of the metals Cd, Pb, Hg, Cu, Bi, Co, Ni, Tl, Ag, In, and Fe. It may be noted that the said metals are included in the class of metals that are depositable as sulfides in Groups I, II and III of the Standard Scheme of Qualitative Analysis e.g. as set out in Qualitative Analysis and the Properties of Ions in Aqueous Solutions, Slowinski, E. J. et al., 1971, W. B. Saunders Company. It may be further noted that in Group II, metals which form amphoteric sulfides cannot be deposited as good quality deposits i.e. it is not possible to obtain good quality deposits of SnS, or $Sb_2S_3$. Secondly, metal ions in Group III which have extremely negative standard potentials are not easily deposited as the sulfide. In this regard, it should be noted that Zn, Al and Mn are Group III metal ions which cannot be easily deposited as the corresponding sulfides.

Elemental tellurium is poorly soluble in most organic solvents and therefore the present electroplating method is more readily applied to the production of metal sulfides and selenides than it is to the production of metal tellurides, and therefore the application of the present method to the deposition of metal sulfides and selenides is particularly preferred.

As noted above, in conducting the electroplating process of the invention, the current density must be limited to avoid an excessive rate of reduction of the metal anion, leading to production of free metal inclusions and other difficulties. It is therefore preferred to conduct the electroplating process under controlled, galvanostatic conditions. The maximum current density that can be employed with any given reaction system can be determined empirically in each case, but usually the current density will not exceed 5 mA per square centimeter of the surface of the cathode, and in the preferred forms of the invention, the said current density is less than 3 mA per square centimeter.

It has been found that the maximum current density that can be used in each case is dependent upon the temperature at which the electrolytic bath is maintained, and upon the concentration of chalcogen dissolved in the electrolytic bath. The greater the temperature and the greater the concentration of the dissolved chalcogen, the greater the permissible limit of current density. Advantageously, the electrolytic bath is maintained at a temperature of at least 80° C., and the bath contains dissolved therein at least 0.005 moles per liter of said chalcogen X. At temperatures and concentrations of chalcogen less than these, the rate of the chalconide-forming reaction in accordance with equation (2) is excessively low, and therefore excessively low current densities have to be employed to avoid free metal formation, so that a smooth, coherent deposit is obtained. At these excessively low current densities, the rates of deposition of the metal chalconides are very slow, and greatly extended periods of time are required for build-up of satisfactory thicknesses of the film. Preferably, the deposition is conducted at a temperature of at least 90° C., and said chalcogen X is present in an amount of at least 0.05 moles (gram atoms of said chalcogen) per liter, more preferably at least 0.1 moles per liter of the bath.

Owing to the high energy costs of maintaining the bath at greatly elevated temperatures, the bath is desirably operated at a temperature not much greater than 150° C. The maximum temperature that is employable is, of course, limited in practice only by the temperature of decomposition of the organic polar solvent. As noted above, the concentration of chalcogen X dissolved in the bath is desirably as high as possible. The maximum concentration is limited in practice by the limit of solubility of the chalcogen in the solvent.

The preferred polar organic solvents are solvents that are capable of dissolving large amounts of the chalcogens, especially, in the preferred form, sulfur and selenium, and that have relatively high boiling points so that there is no need to pressurize the apparatus to super-atmospheric pressures in order to achieve satisfactorily elevated bath temperatures without boiling the solvent. As noted above, it is normally desired to operate the process at temperatures in the range of 90° to 150° C., and therefore the preferred solvents are liquids having boiling and decomposition points in excess of 150° C. at normal atmospheric pressure. The solvent should be one in which the solubility of the chalcogen is at least 0.005 moles per liter, and as indicated above, preferably at least 0.05 moles per liter, in order that an adequate concentration of chalcogen may be present to avoid formation of free metal inclusions at practicable current densities. The solvent can be a protic solvent or an aprotic solvent. The presently preferred solvents are dimethylsulfoxide, dimethylformamide, ethylene glycol, propylene carbonate, and mixtures thereof. The presence of large amounts of dissolved water in the solvent is undesirable, as this reduces the solubility of the chalcogen therein. The use of elevated temperatures for conducting the process has the additional advantage that the moisture content of the bath is maintained at a low level, as at elevated temperatures there is little tendency for hygroscopic absorption of moisture into the solvent from the atmosphere, and any residual moisture tends to be volatilized and expelled from the bath. Although moisture contents of up to 20% by weight of the bath can be tolerated, the moisture content is advantageously no more than 10%, more desirably less than 5% of the weight of the bath. In the presently preferred forms of the invention, the solvents that are employed are substantially anhydrous.

It has been found that certain of the preferred solvents, namely dimethylsulfoxide and dimethylformamide, and of these more notably the dimethylsulfoxide, exhibit a surface activity at the cathode, discussed in more detail below, that is especially beneficial for the deposition of the metal chalconides in smooth, coherent film form, and these solvents are for that reason especially preferred.

In general, the salt of the metal M that is employed can be any salt that is soluble in the organic polar solvent and that exists in solution therein in the form of ions, so that it can serve as an electrically-conductive electrolyte in solution in the solvent. Desirably, the metal salt is a salt of a strong acid that is non-reactive with respect to the solvent and the chalcogen. Thus, salts of strong oxidizing or reducing acids such as sulfates, sulfites, nitrites and hypohalites are not preferred, as they may exert an oxidizing or reducing action on the chalcogen, or may exert in oxidizing action on the organic polar solvent. Desirably the metal salt is soluble in the solvent to an extent of at least 0.01 moles per liter of the bath. Below this amount, the overpotential for the reduction of the metal cation in accordance with equation (1) may be so negative that other, undesired electroreduction processes may occur if the reaction is conducted, as is normally desired, under galvanostatic conditions, due to the occurrence of these undesired side-reactions in preference to the electro-reduction of the metal cation. The upper limit for the content of metal salt is dictated in practice by the limit of the solubility of the salt in the solvent. Typically the salt will be present in an amount of up to about 1 mole per liter of the bath, and more typically is present in an amount of about 0.02 to about 0.8 moles per liter of the bath.

The preferred metal salts are halides i.e. chlorides, bromides, and iodides, and cyanides, and thiocyanates. These anions are relatively unreactive with the preferred organic polar solvents and with the chalcogens, and it has been found that certain of these also exhibit a surface active effect at the cathode that is exceptionally beneficial for the formation of a satisfactory smooth, coherent film of the metal chalconide.

In particular, the presence of halide ions and more particularly iodide ions in the electrolytic bath is especially beneficial to the formation of smooth, coherent metal chalconide films. Iodine ions are known to be strongly adsorbed at metal surfaces, and it is suggested that in the process of the present invention, the addition of iodide anion results in adsorption of the iodide anions on the surface of the cathode, thus leading to localized negative charges on the cathodic surface that influence the attraction of the cations of the metal M to the cathodic surface and their discharge to provide the reactive species M*. Bromide ions, and to a lesser extent, chloride ions, are also strongly adsorbed on the surface of the cathode, and exhibit a similar surface active effect. Cyanide and thiocyanate ions also exhibit some degree of desirable surface activity, but to a lesser extent that iodide.

As noted above, certain of the preferred solvents exhibit jointly with certain of the aforementioned anions a beneficial surface active effect that is conducive to the formation of smooth, coherent films. Thus, it has been found that where dimethylsulfoxide is employed as solvent, satisfactory smooth, coherent films can be obtained of chalconides of each of said metals Cd, Pb, Cu, Bi, Co, Ni, Tl, Ag, In, and Fe in the presence of an effective, surface active amount of chloride anion. It may be noted that the chloride anion may be present in the bath due to the use of a chloride of said metal M as the metal-containing electrolyte that is dissolved in the bath. In the case of each of said preferred solvents dimethylsulfoxide, dimethylformamide, ethylene glycol, and propylene carbonate, a satisfactory chalconide film can be obtained by adding an effective surface-active amount of iodide anion. As noted above, the addition of iodide anion is not required in dimethylsulfoxide solutions where the chloride anion normally added as part of the metal salt is sufficiently surface active. Further, iodide anion is not required in the case of deposition of nickel or cobalt chalconide deposited from dimethylformamide solutions.

Where a source of surface-active anion is added in addition to the quantity of surface-active anion, if any, that may be present in the salt of the metal M that is dissolved as metal-containing electrolyte, said anion is desirably added in the form of a relatively inert salt of an alkali metal e.g. sodium, potassium, rubidium, or of an alkaline earth metal e.g. magnesium, calcium, strontium, or barium.

In general, the effective amount of surface-active anion, if any, that is required will be in the range of from 0.01 to 1.5 moles per liter of bath, more preferably 0.05 to 1.2 mole per liter. In the case of electro deposition of mercuric sulfide ($H_gS$) it is desirable to employ added iodine anion, owing to the highly positive standard potential of the reduction reaction $$Hg^{++}+S+2e \rightarrow HgS$$

Hence, in the absence of iodide ion, the potential that is required in order to achieve electrodeposition of the sulfide is of such magnitude that the organic solvent would in most cases be oxidized.

However, in the presence of iodide anion, the reduction reaction that occurs is $HgI_2+S+2e \rightarrow HgS+2I^-$, and as the standard potential for this reaction is much more electronegative, it can take place without risk of oxidation of the solvent.

Where the electrolytic bath contains iodide anion, it is desirable to avoid contact of the anode with the iodide-containing solution as the iodide anion may be oxidized to elemental iodine and this is troublesome not only because of the evolution of large quantities of noxious iodine vapour, but also because migration of elemental iodine to the cathode and its subsequent reduction to iodide ion may interfere with the desired electrode process. Separation of the anolyte from the catholyte can be achieved using any convenient means that permit electrical contact between the anode and the main body of the electrolytic bath, while preventing gross mixing of the main body of the electrolytic bath with the environment around the anode. One convenient method is to immerse the anode in a solution formed from the same solvent used in the main body of the bath and having dissolved therein any suitable electrically conductive salt that is inert with respect to the anode potential, and to separate this solution from the main body of the bath using a liquid-porous barrier that prevents gross mixing of the solution with the main body of the bath.

Separation of the anolyte from the catholyte is also desirable where the metal M has variable-valency ions that are oxidizable and reducible at the anode and cathode potentials achieved in the electroplating process, otherwise the efficiency of the electroplating process may suffer due to undesired oxidation and reduction side-reactions. For example, in the case of deposition of cuprous sulphide, it is desirable to separate the anolyte from the catholyte to reduce the tendency for cuprous ion to be oxidized to cupric ion at the anode, which cupric ion on migration to the cathode will be re-reduced to cuprous ion before being discharged as the active copper metal species.

Examples of suitable conductive substrates on which the films may be deposited in accordance with the invention, and which may therefore be employed as the cathode in the above-described process include nickel, stainless steel, gold, platinum, tin oxide coated glass, tin, zinc, and indium. Preferably, the cathode should be inert with respect to the chalcogen to avoid possibly undesirable side-reactions. Where the deposition is conducted on nickel or stainless steel, owing to the passivating oxide film that is normally present on these metals, a strong adherency of the chalconide film to the substrate is not obtained, and to render the deposit non-peelable, the deposit must be stabilized by annealing it at a temperature of about 200° to 250° C., preferably about 240° C., in an inert atmosphere.

Adherent, non-peelable deposits can be obtained directly on inert metal such as platinum and gold without the need for any subsequent annealing step.

The metal chalconide films that are obtained with the present process can range in thickness from very thin, monomolecular layers up to films of considerable thickness. The thickness of the deposit can be closely controlled, as the process proceeds quantitatively according to the current passed, and therefore at very low current densities, the thickness of the film can be controlled so that films of an appropriate thickness can be obtained by passing the calculated amount of current for the appropriate length of time. With the non-conducting or semi-conducting chalconides, as the thickness of the deposit increases, the electrical resistance increases, and therefore to some extent this controls the thickness that can be achieved in each particular case. However, with some chalconides, e.g. cadmium sulfide, which exhibit photoelectric properties, the conductivity of the film can be increased by irradiating the growing face of the film during the deposition process, so that thicker films can be deposited. In most cases, it is not desired to achieve a thickness of greater than about $10^{-4}$ meters, and for most purposes, films of thickness from about $5\times10^{-7}$ to about $10^{-5}$ meters are preferred.

As noted above, the present electrodeposition method can be used to co-deposit two or more metallic chalconides. For example, a minority deposit may be added to a metal chalconide film e.g. a semiconductor chalconide film. This can be achieved using an electrolytic path containing a major amount of a salt of one of the metals X and a minor amount of a salt of another of said metals. In one example, thallium (Tl) may be added as a minority dopant to a semiconductor film of CdS. This may be achieved using a bath containing $CdCl_2$ and S dissolved in dimethylsulfoxide with additions of TlCl (thallous chloride) in amounts ranging from 0.001 mole to 0.2 mole per mole of $CdCl_2$. In this manner, the resistivity of the resultant film can be varied by control of its content of the Tl dopant, the resistivity of the film decreasing according to the quantity of TlCl added to the bath.

The present process may also be employed to deposit metal chalconides sequentially. For example, by interrupting the electrodeposition process, and recommencing the process employing another appropriately selected metal cation, it may be mentioned that, for example, cadmium sulfide (CdS) can be deposited on mercuric sulfide (HgS) and cuprous sulfide ($Cu_2S$). Further, cuprous sulfide ($Cu_2S$) can be deposited on cadmium sulfide (CdS).

Sulfur is the preferred chalcogen for use in the present invention by reason of its lack of toxicity and its relatively low cost. As will be understood by those skilled in the art, the chalcogens selenium and tellurium are closely analagous to sulfur in their properties, and may be substituted for sulfur in the process of the present invention making such changes or modifications to the process as will readily be apparent to those skilled in the art as being necessary. Thus, for example, in view of the lesser solubility of elemental selenium in polar organic solvents and in view of the relatively poor solubility of tellurium in most solvents, the electrodeposition should be carried out at a lower current density than that employed when sulfur is employed as the chalcogen, to avoid an excessive rate of production of active metal atom species M* relative to the concentration of dissolved chalcogen, so that free metal inclusions are not formed and the production of non-glassy non-coherent films is avoided.

The accompanying drawings illustrate, partly schematically, and partly in vertical section, one form of apparatus that may be used for carrying out the present method. The apparatus comprises a three-necked glass vessel 10 having a central neck 11 and necks 12 and 13 disposed symmetrically on either side. Electrode-holding glass fittings 14, 16, and 17 are received in the necks 11, 12, and 13, respectively. The central fitting 14 carries a glass stem 18 through which passes a lead 19 to the cathode 21, and fittings 16 and 17 carry glass stems 22 and 23, through which pass leads 24 and 26 to a pair of anodes 28 and 29, respectively.

A magnetic stirrer body 31 is provided for stirring the electrolytic bath that is contained in the vessel 10. The bath 32 contains the polar organic solvent having dissolved therein the salt of the metal M and the elemental chalcogen X.

The temperature of the vessel 10 is controlled by having it immersed in an oil bath 33 maintained at a constant known temperature, contained within a suitable vessel 34.

Provision can be made for separation of the anolyte and the catholyte by surrounding each anode 28, 29 with glass tubes (shown in broken lines 36,37). Each of the tubes 36 and 37 is closed at its bottom with a fritted glass disk 38,39 of medium porosity that permits electrical conduction between the liquids inside the tubes 36, 37 and the main body of the bath 32, while preventing or restricting gross mixing of the two liquids. Where separation of the anolyte from the catholyte is required, the interior of the tubes 36 and 37 will be filled with a conductive liquid compatible with the main body of the bath 31.

In other to avoid excessive build-up of pressure within the vessel 10, vent apertures 41, 42, and 43 may be provided in the central neck 11 and in the glass fittings 16 and 17, respectively.

The anode leads 24 and 26 are connected in common through the output of a conventional galvanostat G, and through a switch 44 to the cathode lead 19. The galvanostat is connected through leads 46, 47 to a D.C. source S. The galvanostat is programmable to supply a constant current in the desired range. For the purposes of the Examples set out in more detail hereinafter, it is desired that the galvanostat G provide an output within the range of about 1mA to about 5mA.

The function of the galvanostat G is that, once it is set to a selected amperage, it automatically adjusts the volts supplied across its output so that a constant amperage is delivered regardless of changes in the resistance load that may occur. In the Examples hereinafter, there is employed a galvanostat G and source S such that applied voltages up to about 70 volts can be obtained.

Some non-limiting Examples of process in accordance with the invention will now be given.

In each of the Examples, apparatus as illustrated in the accompanying drawings is employed, using 100 ml of organic polar solvent as the bath 32, having the salts and elemental chalcogens specified dissolved therein in the amounts indicated.

In the Examples, DMSO represents dimethylsulfoxide, DMF is dimethylformamide, and PC is propylene carbonate.

The cathode 21 consists in each case of a square piece of metal foil 1 cm × 1 cm immersed in the bath 32. The anodes 28 and 29 are pieces of platinum foil of the same size as the cathode, each separated from the cathode 21 by a distance of 2 cm and mounted so that their surfaces are parallel to those of the cathode 21. This geometry ensures uniform current density, and thus uniformity of thickness and of other characteristics of the chalconide film that is electrodeposited on the surfaces of the cathode 21. In instances where separation of the anolyte and catholyte are required, the glass tubes 36, 37 are employed, each ending in a fritted glass disk 38, 39 of medium porosity. The tubes 36, 37 are filled with a saturated solution of KCNS dissolved in the same solvent as used in the main body of bath 32. The bath 32 is stirred using the magnetic stirrer body 31, and its temperature is controlled at the temperature indicated by immersing it in the oil bath 33 maintained at the desired constant temperature. No protective atmosphere is used in the vessel 10.

In each case, analytical grade solvents are used without further purification. Commercially available analytical grade salts can be used as the metal salts that are dissolved in the bath. Prior to use the salts were dried under vacuum at a temperature of 150° C. The selenium used is prepared in the red allotropic form by reducing $Na_2SeO_3$ with $Na_2SO_3$ in a solution of 1 molar HCl. The product is carefully washed with distilled water and is dried at room temperature. The electroplating solutions used in the bath 32 are stable for several months. They may be stored in a covered glass container with no special precautions against the normal ambient atmosphere.

During the electrolysis, a constant current is supplied from the galvanostat G, at the amperage specified.

EXAMPLE 1

In order to deposit CdS, a bath of the following composition is employed.

| | |
|---|---|
| DMSO | 100 mls |
| S | 0.6 g. |
| $CdCl_2$ | 1.0 g. |

The current density is 2.5 mA $cm^{-2}$, and the temperature is maintained at 110° C.

EXAMPLE 2

In order to deposit CdS, a bath of the following composition is employed.

| | |
|---|---|
| DMF | 100 mls |
| S | 0.6 g. |
| $CdCl_2$ | 1.0 g. |
| KI | 1.0 g. |

The current density is 2.5 mA $cm^{-2}$, and the temperature is maintained at 120° C. Owing to the presence of iodide ion, the anolyte is separated from the catholyte.

EXAMPLE 3

In order to deposit CdS, a bath of the following composition was employed.

| | |
|---|---|
| DMF | 15 mls |
| PC | 85 mls |
| S | 0.6 g. |
| $CdCl_2$ | 1.0 g. |
| KI | 1.0 g. |

The current density and temperature maintained are as in Example 1. The anolyte is separated from the catholyte, to avoid iodine production at the anode.

EXAMPLE 4

In order to deposit CdS, the following bath composition is employed.

| | |
|---|---|
| Ethylene Glycol | 100 mls |
| S | 0.6 g. |
| $CdCl_2$ | 1.0 g. |
| KI | 5.0 g. |

The current density is maintained at 1.5 mA $cm^{-2}$, the temperature is maintained at 130° C. Owing to the presence of iodide ion, the anolyte must be separated from the catholyte.

EXAMPLE 5

In order to deposit CdSe, a bath with the following composition is employed.

| | |
|---|---|
| DMF | 100 mls |
| Se | saturated solution |
| $CdCl_2$ | 1.0 g. |
| KI | 1.0 g. |

The current density is maintained at 0.5 mA $cm^{-2}$, and the temperature is maintained at 120° C.Anolyte is separated from the catholyte.

EXAMPLE 6

In order to deposit HgS, a bath with the following composition is employed.

| | |
|---|---|
| DMSO | 100 mls |
| $HgI_2$ | 2.3 g. |
| KI | 0.8 g. |
| S | 0.6 g. |

The current density is 2.5 mA $cm^{-2}$, and the temperature is 110° C. Anolyte must be separated from the catholyte.

EXAMPLE 7

For depositing $Cu_2S$, a bath of the following composition is employed.

| | |
|---|---|
| DMSO | 100 mls |
| CuCN | 0.5 g. |
| S | 0.6 g. |
| CsCl | 0.5 g. |

The current density and temperature are maintained as in Example 6. The anolyte must be separated from the catholyte, to avoid oxidation of the cuprous ion to cupric ion at the anode.

EXAMPLE 8

In order to deposit $Tl_2S$, a bath of the following composition is employed.

| | |
|---|---|
| DMSO | 100 mls |
| TlCNS | 1.5 g. |
| S | 0.6 g. |

The current density and temperature are maintained as in Example 6.

EXAMPLE 9

In order to deposit $Bi_2S_3$, a bath of the following composition is employed.

| | |
|---|---|
| DMSO | 100 mls |
| $BiCl_3$ | 1.5 g. |
| S | 0.6 g. |

The temperature and current density are as in Example 6.

EXAMPLE 10

To deposit PbS, a bath of the following composition is employed.

| | |
|---|---|
| DMSO | 100 mls |
| $PbCl_2$ | 1.5 g. |
| S | 0.6 g. |

The temperature and current density are maintained as in Example 6.

EXAMPLE 11

To deposit NiS, a bath having the composition indicated below is employed.

| | |
|---|---|
| DMF | 100 mls |
| $NiCl_2$ | 0.5 g. |
| S | 0.6 g. |

The temperature and current density are maintained as in Example 6.

EXAMPLE 12

In order to deposit CoS, a bath having the composition indicated below is employed.

| | |
|---|---|
| DMF | 100 mls |
| $CoCl_2$ | 0.5 g. |
| S | 0.6 g. |

The temperature and current density are maintained as in Example 6.

EXAMPLE 13

To deposit $Ag_2S$ a bath having the following composition is employed.

| | |
|---|---|
| DMSO | 100 mls |
| AgSCN | 1 g. |
| NaSCN | 1.5 g. |
| S | 0.5 g. |

The temperature and current density are as in Example 6.

EXAMPLE 14

To deposit $In_2S_3$, a bath of the following composition is employed.

| | |
|---|---|
| DMSO | 15 mls |
| PC | 85 mls |
| $InCl_3$ | 1 g. |
| S | 0.5 g. |

The temperature and current density are as in Example 6.

EXAMPLE 15

To deposit CdS doped with thallium (Tl), a bath of the following composition is employed.

| | |
|---|---|
| DMSO | 100 mls |
| $CdCl_2$ | 1 g. |
| S | 0.5 g. |
| TlCl | 0.002 g. to 0.2 g. |

The temperature and current density are as in Example 6. The resistivity of the film obtained decreases according to the quantity of TlCl dissolved in the bath.

EXAMPLE 16

To deposit a CdS/CdSe film, a bath of the following composition is employed.

| | |
|---|---|
| DMSO | 100 mls |
| Se | saturated solution (0.2 g.) |
| S | 0.5 g. |
| $CdCl_2$ | 1 g. |

The temperature and current density are as in Example 6. In making up the bath, the sulfur and cadmium chloride are dissolved in the bath first, as the presence of the S and $CdCl_2$ in solution facilitates dissolving the Se in the bath.

In each of the Examples discussed above, the electrical properties of the metal chalconide films that are obtained are the same as those of films obtained by prior methods. Thus, films of cadmium sulphide (CdS), cadmium selenide (CdSe), bismuth sulphide ($Bi_2S_3$), mercury sulphide (HgS) and lead sulphide (PbS) obtained by the present invention are n-type semiconductors. Nickel sulphide (NiS) and cobalt sulphide (CoS) films obtained by the invention have metallic type conductivity; these compounds are also catalysts for electrode processes involving sulphur in low oxidation states. Cuprous sulphide ($Cu_2S$) and thallium sulphide ($Tl_2S$) films as obtained by the present process are p-type semiconductors.

In each case, films ranging in thickness from 1 or more molecular monolayers up to, for example, about $10^{-5}$ meters in thickness can readily be obtained by continuing the electrolysis for the period of time that is calculated to discharge the requisite quantity of metal cation.

We claim:

1. A method for producing a smooth coherent mixed metallic chalconide film of which the metal moiety is a metal selected from the group consisting of Cd, Pb, Hg, Cu, Bi, Co, Ni, Tl, Ag, In, Fe, and mixtures thereof and the chalconide moiety is a chalcogen selected from the group consisting of S, Se, Te and mixtures thereof, at least one of said metal and said chalcogen comprising a mixture, comprising the steps of providing an electrolytic bath comprising an organic polar solvent having dissolved therein (a) said metal in the form of a salt that is ionised and is electrically conductive in solution in said solvent and (b) said chalcogen in elemental form; maintaining the bath at elevated temperature above about 80° C.; subjecting the bath to electrolysis at a current density that is sufficiently low with respect to the surface area of the cathode that a smooth coherent film of said mixed chalconide is deposited on the cathode; and continuing the electrolysis until a desired thickness of film has built up on the cathode.

2. A method as claimed in claim 1 in which the solvent is selected from the group consisting of dimethylsulfoxide, dimethylformamide, ethylene glycol, propylene carbonate, and mixtures thereof.

3. A method as claimed in claim 1 wherein said metal salt (a) is a salt of a strong acid that is non-reactive with respect to the solvent and the chalcogen.

4. A method as claimed in claim 3 wherein said salt (a) is a metal halide, metal cyanide, metal thiocyanate or a mixture thereof.

5. A method as claimed in claim 1 wherein said salt (a) is present in an amount of from 0.01 mole per liter of the bath up to the limit of solubility of the salt in said solvent.

6. A method as claimed in claim 1 wherein said chalcogen (b) is present in an amount of from 0.005 moles per liter up to its limit of solubility in said solvent.

7. A method as claimed in claim 1 wherein the bath is maintained at a temperature of from 90° C. up to the decomposition temperature of said solvent.

8. A method as claimed in claim 1 wherein said current density is less than 5 mA per sq. cm of the surface area of the cathode.

9. A method as claimed in claim 1 wherein said chalcogen comprises a mixture of S and Se.

10. A method as claimed in claim 1 for producing a CdS film doped with Tl wherein the metal salt (a) in the bath comprises a major amount of Cd salt and a minor amount of Tl salt.

11. A method as claimed in claim 10 wherein the bath contains from 0.001 mole to 0.2 mole Tl salt per mole of Cd salt.

12. A method for producing a smooth coherent film of a metal chalconide of which the metal moiety is a metal selected from the group consisting of Ag, In, and Fe, and the chalconide moiety is a chalcogen selected from the group consisting of S, Se, and Te, comprising the steps of providing an electrolytic bath comprising an organic polar solvent having dissolved therein (a) a salt of said metal that is ionised and is electrically conductive in solution in said solvent and (b) said chalcogen in elemental form; maintaining the bath at elevated temperature above about 80° C.; subjecting the bath to electrolysis at a current density that is sufficiently low with respect to the surface area of the cathode that a smooth coherent film of said chalconide is deposited on the cathode; and continuing the electrolysis until a desired thickness of film has built up on the cathode.

13. A method according to claim 12 in which the solvent is selected from the group consisting of dimethylsulfoxide, dimethylformamide, ethylene glycol, propylene carbonate, and mixtures thereof.

14. A method as claimed in claim 12 wherein said metal salt (a) is a salt of a strong acid that is non-reactive with respect to the solvent and the chalcogen.

15. A method as claimed in claim 14 wherein said salt (a) is selected from the group consisting of metal halides, metal cyanides, and metal thiocyanates.

16. A method as claimed in claim 12 wherein said salt (a) is present in an amount of from about 0.01 mole per liter of the bath up to the limit of solubility of the salt in said solvent.

17. A method as claimed in claim 12 wherein said chalcogen (b) is present in an amount of from about 0.005 moles per liter up to its limit of solubility in said solvent.

18. A method as claimed in claim 12 wherein the bath is maintained at a temperature of from 90° C. up to the decomposition temperature of said solvent.

19. A method as claimed in claim 1 wherein said current density is less than about 5 mA per sq. cm of the surface area of the cathode.

20. A method for producing a smooth coherent film of a metal chalconide of which the metal moiety is a metal selected from the group consisting of Cd, Pb, Hg, Cu, Bi, Co, Ni, Tl, Ag, In, and Fe, and the chalconide moiety is Te comprising the steps of providing an electrolytic bath comprising an organic polar solvent having dissolved therein (a) a salt of said metal that is ionised and is electrically conductive in solution in said solvent and (b) said chalcogen in elemental form; maintaining the bath at elevated temperature above about 80° C.; subjecting the bath to electrolysis at a current density that is sufficiently low with respect to the surface area of the cathode that a smooth coherent film of said chalconide is deposited on the cathode; and continuing the electrolysis until a desired thickness of film has built up on the cathode.

21. A method according to claim 20 in which the solvent is selected from the group consisting of dimethylsulfoxide, dimethylformamide, ethylene glycol, propylene carbonate, and mixtures thereof.

22. A method as claimed in claim 20 wherein said metal salt (a) is a salt of a strong acid that is non-reactive with respect to the solvent and the chalcogen.

23. A method as claimed in claim 22 wherein said salt (a) is selected from the group consisting of metal halides, metal cyanides, and metal thiocyanates.

24. A method as claimed in claim 20 wherein said salt (a) is present in an amount of from about 0.01 mole per liter of the bath up to the limit of solubility of the salt in said solvent.

25. A method as claimed in claim 20 wherein said chalcogen (b) is present in an amount of from about 0.005 moles per liter up to its limit of solubility in said solvent.

26. A method as claimed in claim 20 wherein the bath is maintained at a temperature of from 80° C. up to the decomposition temperature of said solvent.

27. A method as claimed in claim 20 wherein said current density is less than about 5 mA per sq. cm of the surface area of the cathode.

28. A method for producing a smooth coherent film of a metal chalconide of which the metal moiety is a metal selected from the group consisting of Cd, Pb, Hg, Cu, Bi, Co, Ni, Tl, Ag, In, and Fe, and the chalconide moiety is a chalcogen selected from the group consisting of S, Se, and Te, comprising the steps of providing an electrolytic bath comprising an organic polar solvent having dissolved therein (a) a salt of said metal that is ionised and is electrically conductive in solution in said solvent and (b) said chalcogen in elemental form; disposing in the bath an anode and a cathode comprising a metal selected from the group consisting of tin, zinc, and indium; maintaining the bath at elevated temperature above about 80° C.; subjecting the bath to electrolysis at a current density that is sufficiently low with respect to the surface area of the cathode that a smooth coherent film of said chalconide is deposited on the cathode; and continuing the electrolysis until a desired thickness of film has built up on the cathode.

29. A method according to claim 28 in which the solvent is selected from the group consisting of dimethylsulfoxide, dimethylformamide, ethylene glycol, propylene carbonate, and mixtures thereof.

30. A method as claimed in claim 28 wherein said metal salt (a) is a salt of a strong acid that is non-reactive with respect to the solvent and the chalcogen.

31. A method as claimed in claim 30 wherein said salt (a) is selected from the group consisting of metal halides, metal cyanides, and metal thiocyanates.

32. A method as claimed in claim 28 wherein said salt (a) is present in an amount of from about 0.01 mole per liter of the bath up to the limit of solubility of the salt in said solvent.

33. A method as claimed in claim 28 wherein said chalcogen (b) is present in an amount of from about 0.005 moles per liter up to its limit of solubility in said solvent.

34. A method as claimed in claim 28 wherein the bath is maintained at a temperature of from 90° C. up to the decomposition temperature of said solvent.

35. A method as claimed in claim 28 wherein said current density is less than about 5 mA per sq. cm of the surface area of the cathode.

* * * * *